US007117611B2

(12) United States Patent
Park et al.

(10) Patent No.: US 7,117,611 B2
(45) Date of Patent: Oct. 10, 2006

(54) BODY HAIR AND FEET DRYING CHAIR

(76) Inventors: Chan J. Park, 11202 Ballantre La., Glenn Dale, MD (US) 20769; Myo Sik Park, 11202 Ballantre La., Glenn Dale, MD (US) 20765

( * ) Notice: Subject to any disclaimer, the term of this patent is extended or adjusted under 35 U.S.C. 154(b) by 162 days.

(21) Appl. No.: 10/945,868

(22) Filed: Sep. 22, 2004

(65) Prior Publication Data

US 2006/0059706 A1 Mar. 23, 2006

(51) Int. Cl.
*F26B 19/00* (2006.01)
*A47C 7/72* (2006.01)

(52) U.S. Cl. ..... 34/90; 34/202; 34/232; 34/235; 297/180.14; 297/217.3

(58) Field of Classification Search ..... 34/90, 34/202, 232, 235; 392/380; 297/180.14, 297/217.3
See application file for complete search history.

(56) References Cited

U.S. PATENT DOCUMENTS 2,666,210 A * 1/1954 Wiley ..... 297/118
2,782,834 A * 2/1957 Vigo ..... 297/180.14
2,846,692 A * 8/1958 Baumann ..... 4/531
3,097,505 A * 7/1963 Smith ..... 297/180.14
3,621,199 A 11/1971 Goldstein
4,411,030 A 10/1983 Kawai et al.
4,509,792 A * 4/1985 Wang ..... 297/180.14
4,780,595 A 10/1988 Alban
4,871,900 A 10/1989 Hickman
4,961,272 A 10/1990 Lee
5,007,182 A 4/1991 Fishman et al.
5,382,075 A 1/1995 Shih
5,491,908 A 2/1996 Ruiz et al.
5,675,907 A 10/1997 Reppas et al.
5,873,179 A 2/1999 Gregory et al.
6,048,024 A 4/2000 Wallman
6,059,018 A * 5/2000 Yoshinori et al. ..... 297/180.14
6,189,231 B1 * 2/2001 Lancer ..... 34/90
2002/0149201 A1 10/2002 Pichotta
2003/0111877 A1 6/2003 Collins et al.

FOREIGN PATENT DOCUMENTS

JP 2003-239362 8/2003

* cited by examiner

*Primary Examiner*—Jiping Lu
(74) *Attorney, Agent, or Firm*—Richard C. Litman

(57) ABSTRACT

The body hair and feet drying chair is a seat comprising an upright base having a top portion, a middle portion, and a bottom portion, and a hollow interior. A seat is disposed on top of the base. At least one air outlet is defined in the seat in communication with the base's hollow interior. At least one air channel is defined in the bottom portion of the base in communication with the base's hollow interior. A motorized fan contained within the hollow interior of the base draws air into the hollow interior through the air channels and expels air from the hollow interior through the air outlets. Air expelled from the air outlets dries genital and posterior areas of a user seated on the body hair and feet drying chair, while air drawn into the air channels dries the user's feet and toes when the user's feet and toes are positioned over the air channels.

6 Claims, 6 Drawing Sheets

BODY HAIR AND FEET DRYING CHAIR

BACKGROUND OF THE INVENTION

1. Field of the Invention

The present invention relates to a human body drying apparatus. More specifically, the invention is a body hair and feet drying chair that circulates air to dry a person's toes and body hair in dampness-prone body areas, especially genital and posterior areas.

2. Description of the Related Art

Damp skin promotes the growth of body-borne fungus, yeasts, and bacteria, often resulting in skin irritation, rash, and other discomforts. Certain areas of the body are especially prone to problems associated with dampness. Areas between the toes, areas surrounding the genitals, and posterior areas around and within the gluteal cleft are prime locations for dampness and the attendant growth of body-borne fungus, yeasts, and bacteria.

A common source of skin dampness is bathing. While regular bathing is necessary for proper personal hygiene, the task of drying oneself after a shower or bath frequently results in incomplete drying, leaving parts of the body damp or wet. The areas between the toes, areas surrounding the genitals, and posterior areas around and within the gluteal cleft are difficult to dry thoroughly with a conventional bath towel. The areas between toes, as well as the posterior areas around and within the gluteal cleft, present a problem of adequate access with a bath towel, while the body hairs surrounding the genitals tend to hold water. Additionally, a natural tendency to sweat after a hot shower or bath ensures that, even with sufficient towel drying, moisture in the form of sweat may quickly reappear.

Air drying apparatus have been used for drying a person's body. Numerous air dryer apparatus have been devised to blow air over a person's body as the person stands in front of, or within, the apparatus. Air, blown over the wet surface of the body, is effective in drying the skin. Additionally, air blown over the skin may have the effect of cooling the body, thereby reducing sweating following a hot shower or bath. However, such apparatus intended for general body drying don't adequately address the special needs of areas between the toes, areas surrounding the genitals, and posterior areas around and within the gluteal cleft.

Air drying apparatus have been incorporated, along with a bidet device, into a toilet to provide for both cleaning and drying of genital and posterior regions. Such apparatus, however, are limited in their use to only the body's genital and posterior regions. Similarly, specialized devices that provide air drying for the feet are ineffective for the rest of the body.

None of the above described apparatus, taken either singly or in combination, is seen to describe the instant invention as claimed. Thus a body hair and feet drying chair adapted for air drying of areas between the toes, areas surrounding the genitals, and posterior areas around and within the gluteal cleft is desired.

SUMMARY OF THE INVENTION

The body hair and feet drying chair provides air-drying for a person's toes, including primarily the areas between toes, and skin and body hair in dampness-prone body areas, especially genital and posterior areas, including areas around and within the gluteal cleft. The body hair and feet drying chair has a base portion having a generally hollow interior, there being a motor-driven fan contained within the hollow interior. A seat is disposed on the top of the base portion. The seat has a rim portion and, centrally located within the rim portion, a depression to accommodate male genitals of a seated user with a minimum of contact with the seat. A plurality of air holes are defined within the seat's depression. The plurality of air holes preferably include air holes having a range of diametric size, ranging from large air holes located in the center of the depression, medium sized air holes surrounding the central large air holes, and smaller holes surrounding the periphery of the depression.

A footrest area is defined in a bottom portion of the base. Within the footrest area are air vents, including slotted air vents for drying a user's toes and the areas between toes, and a plurality of smaller air vents distributed generally in a foot-shaped outline to provide additional drying air flow to the user's feet in general.

The motor driven fan draws air in through the slotted air vents of the foot supports, blowing the air out of the air holes in the seat depression. Thus, a user's toes, and particularly the areas between the toes, are air-dried as air is drawn into the body hair and feet drying chair, while areas surrounding the user's genitals and posterior areas around and within the gluteal cleft are air-dried by the air exiting the body hair and feet drying chair.

The body hair and feet drying chair thus provides air drying for body areas that are prone to dampness and difficult to adequately dry, and are, therefore, subject to fungal and bacterial infections. While improved drying may not fully cure such infections, it significantly helps to reduce the risk of becoming infected.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
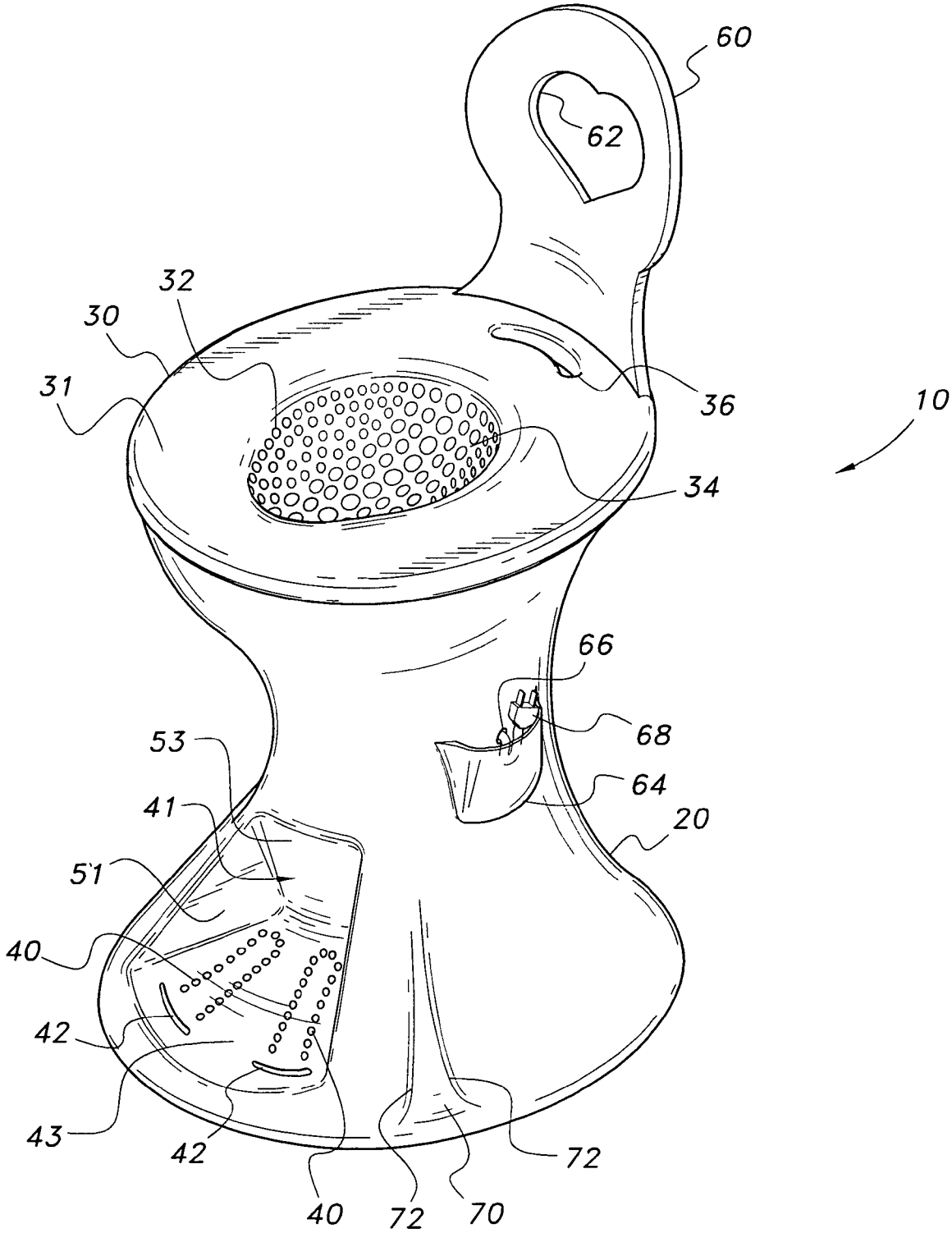
FIG. 1 is an environmental, perspective view of a body hair and feet drying chair according to the present invention.

The present invention is a body hair and feet drying chair. Referring to FIG. 1, an embodiment of the body hair and feet drying chair, designated generally as 10 in the drawings, is shown. The body hair and feet drying chair 10 comprises a seat 30 disposed atop an upright base 20, whereby a person can sit comfortably on the body hair and feet drying chair 10. The upright base 20 has a hollow interior, and is generally covered at the top by the seat 30, the bottom being left open.

A plurality of apertures, or air outlets 34, are defined centrally within the seat 30 to allow air, blown by a motorized fan within the base 20, to be directed to a seated user's genital areas, body hair surrounding the genitals, and posterior. The air flow directed to these body areas provides a more thorough and complete drying of these body areas than can be achieved by towel drying. An additional air outlet 36 is defined in the seat 30 as a slot near the back of the seat 30. Air expelled from the air outlet 36 is directed to the seated user's lower back, helping to dry the small of the back.

Near the bottom, and on the front side, of the base 20, air channels 42 are defined through the base 20, the air channels 42 being slots having a length that is approximately the same as the width of the toes of a typical human foot. A pair of air channels 42 are shown in the illustrated embodiment, one air channels 42 for each of a user's feet. Alternate configurations of the air channels 42 may be used, including a single air channel 42 having a sufficient width to accommodate both of a user's feet, or multiple smaller air channels 42 for each foot. Additional air channels 40 are small apertures arranged in the outline of a foot, to increase the drying coverage for the entire foot. A seated user places her feet on the base 20 such that her toes overlie the air channels 42, the rest of her foot overlying the air channels 40. As the motorized fan within the base 20 blows air out through the air outlets 34 and 36, air is drawn into the base 20 through the air channels. Thus, air is drawn around the seated user's toes and feet, thereby drying the toes and feet, and in particular the regions between the toes.

Figure 2:
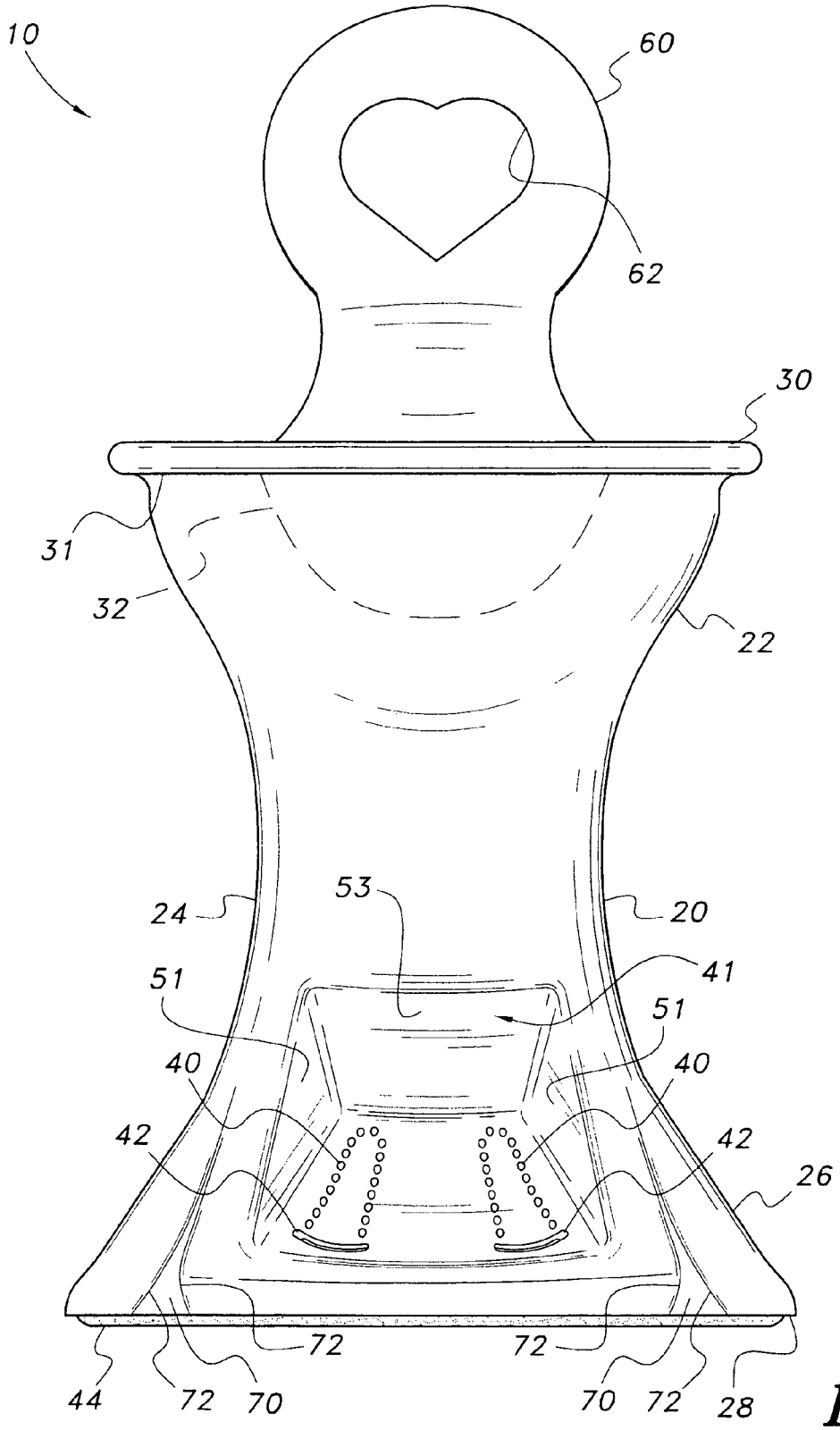
FIG. 2 is a front view of the body hair and feet drying chair of FIG. 1.

As seen in FIGS. 1 and 2, a footrest area 41 is defined in the base 20, the foot rest area 41 being a depression having a floor 43, a pair of sidewalls 51 and a back wall 53 positioned for comfortable placement of the user's feet and positioning of the user's legs. The air channels 40, 42, are formed through the floor 43 of the footrest area 41. The footrest area 41 provide guidances to the user for proper placement of the feet on the body hair and feet drying chair 10 for best drying of the toes. Alternatively to the single footrest area 41 illustrated, a pair of smaller footrests, one for each of a user's feet, may be used.

A seat back 60 is provided for comfort. The seat back 60 may be formed integrally with the seat 30 or base 20, or may be removably attached to either the seat 30 or base 20. An opening 62 through the seat back 30 allows improved air circulation in the region of the user's back, promoting improved air drying of the user's back.

A pocket 64 may be formed on either side, or on each side of the base 20. Each pocket 64 may be used to hold accessories, magazines, or the like. Additionally, a power cord 68, providing electrical power to the motorized fan within the base 20, may be stowed within a pocket 64. An aperture 66 is formed through each side of the base 20, and may be located within a pocket 64 so that the apertures 66 are somewhat hidden. The electrical cord is extended from the base 20 through one of the apertures 66. The power cord 68 is extended through one of the apertures 66, on the side of the base 20 most convenient to an electrical outlet. An unused aperture 66 may be covered with a piece of tape or the like to prevent air entry, thereby improving the drying air flow through the body hair and feet drying chair 10.

Figure 3:
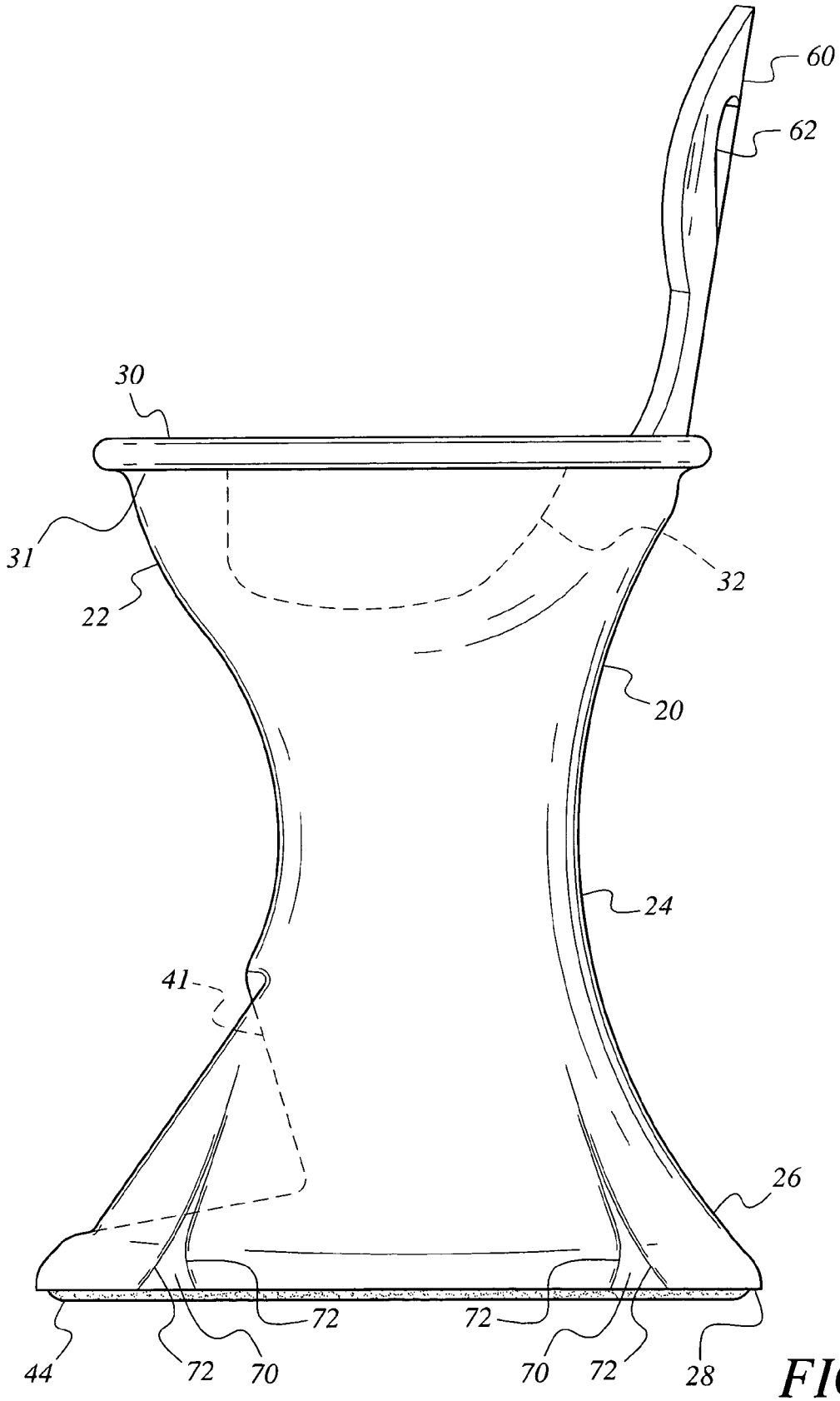
FIG. 3 is a side view of the body hair and feet drying chair of FIG. 1.

Referring now to FIGS. 1–3, it can be seen that the base 20 has a somewhat hourglass shape, having a widened bottom portion 26, a relatively narrow middle portion 24 and a widened top portion 22. The base 20 has an open bottom 29, surrounded by a bottom edge 28 (seen in FIGS. 5 and 6). The seat 30 is disposed atop the widened top portion 22 of the base 20. A center region 32 of the seat 30 is formed into a concave depression to accommodate male genitals of a seated user with a minimum of contact with the seat 30. The portion of the seat 30 surrounding the center region 32 is referred to as a rim portion 31 of the seat 30. The air outlets 34 are confined to the center region 32 of the seat 30, while the air outlet 36 is located along the rear periphery of the rim portion 31 of the seat 30.

The air channels 40 and 42, and the coincident footrest area 41, are defined in the front of the bottom portion 26 of the base 20. The front of the bottom portion 26 of the base 20 may be contoured or extended forward to provide for the comfortable placement of a user's toes and feet over the air channels 40 and 42.

A rubber O-ring 44 is disposed along the bottom edge 28 of the base 20. The O-ring 44 provides an air seal between the bottom edge 28 of the base 20, ensuring that air is drawn into the base 20 through the air channels 40 and 42, rather than through spaces between bottom edge 28 and a floor, as might result if the body hair and feet drying chair 10 is used on an uneven floor surface. Additionally, the O-ring 44 provides protection to the floor surface against damage or abrasion caused by the body hair and feet drying chair 10.

The bottom portion 26 of the base 20 is strengthened by a plurality (four in the illustrated embodiment) of small valleys 70 defining broad ridge areas 72, giving the bottom portion 26 of the base 20 somewhat of a stylized four-leafed clover or flower petal appearance. In addition to creating a stylized appearance, the valleys 70 and ridge areas 72 help to distribute weight forces and minimize the development of small cracks in the base 20.

Figure 4:
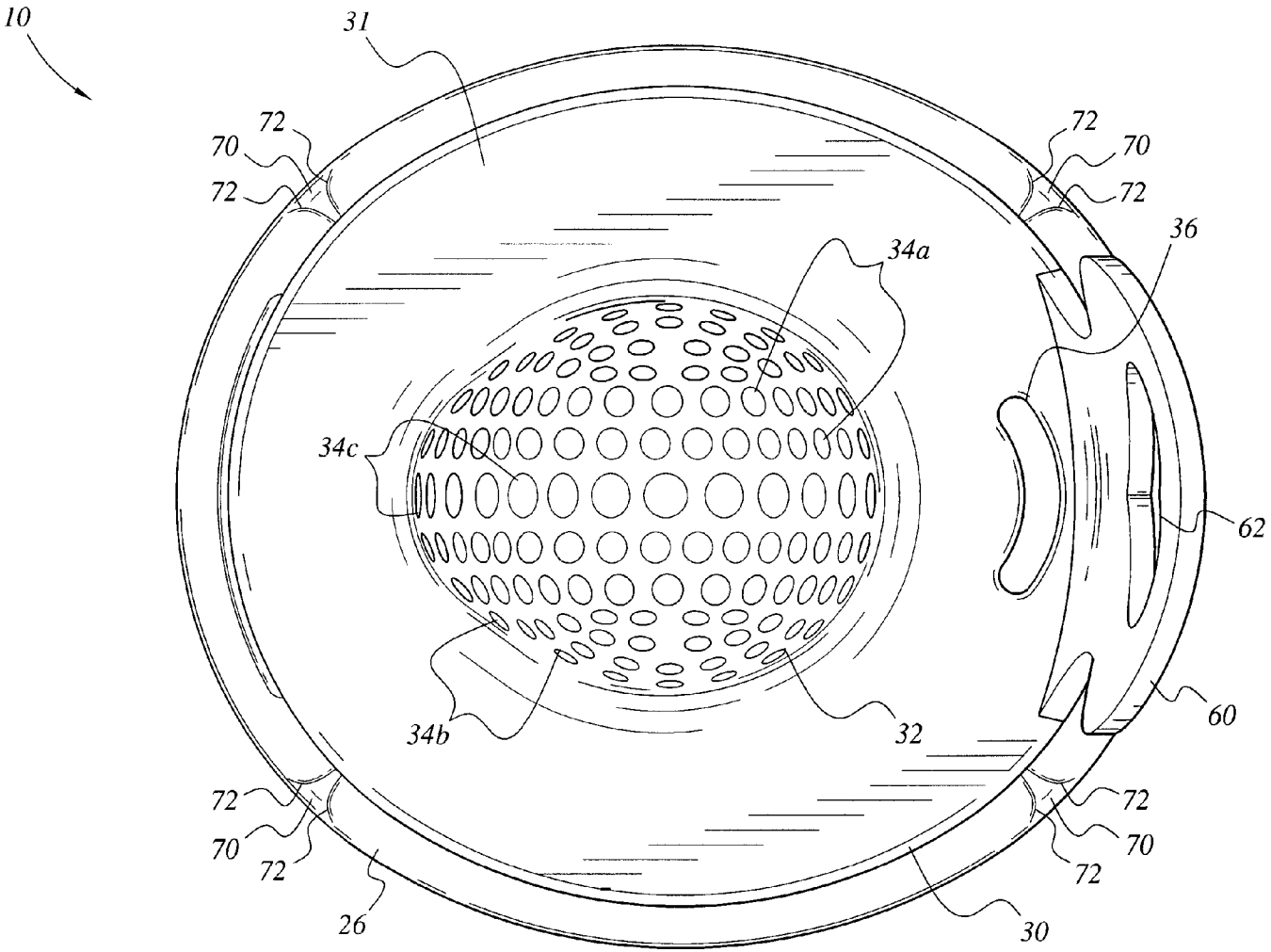
FIG. 4 is a top view of the body hair and feet drying chair of FIG. 1.

Turning now to FIG. 4, the arrangement of air outlets 34 and 36 is best shown. The air outlets 34, defined within the center region 32 of the seat 30, include large air outlets 34C centrally located within the center region 32 of the seat 30. Surrounding the large air outlets 34C are medium air outlets 34A, the medium air outlets 34A being surrounded by small air outlets 34B at the periphery of the center region 32 of the seat 30. The decreasing size of the air outlets 34 from the center to the periphery of the center region 32 of the seat 30 helps to direct the airflow, concentrated more centrally within the seating area, toward the genital and posterior areas of a user's body. The air outlet 36 is located in the seat 30 outside the center region 32 to provide a drying airflow generally toward the small of a seated user's back.

Figure 5:
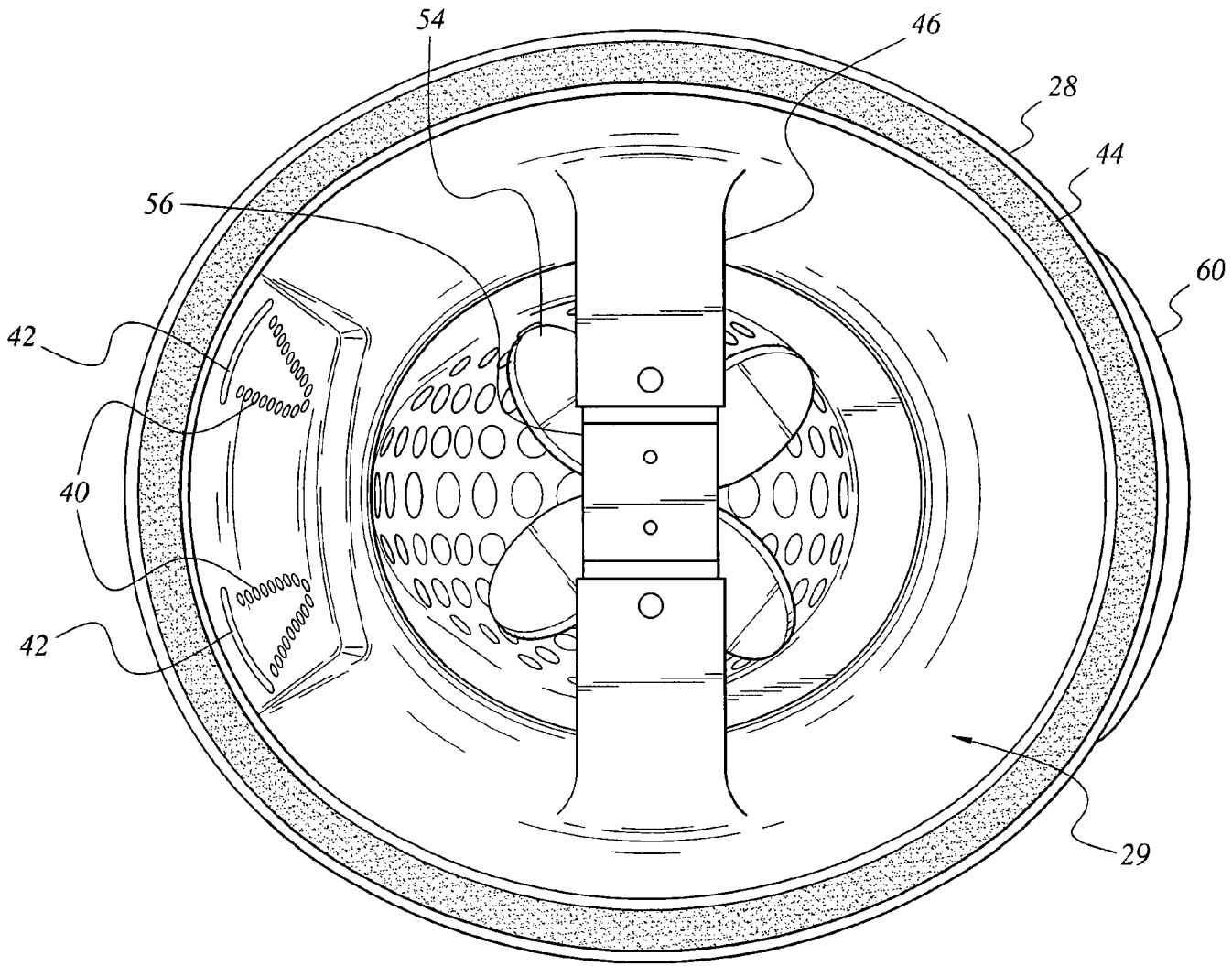
FIG. 5 is a bottom view of the body hair and feet drying chair of FIG. 1.
Figure 6:
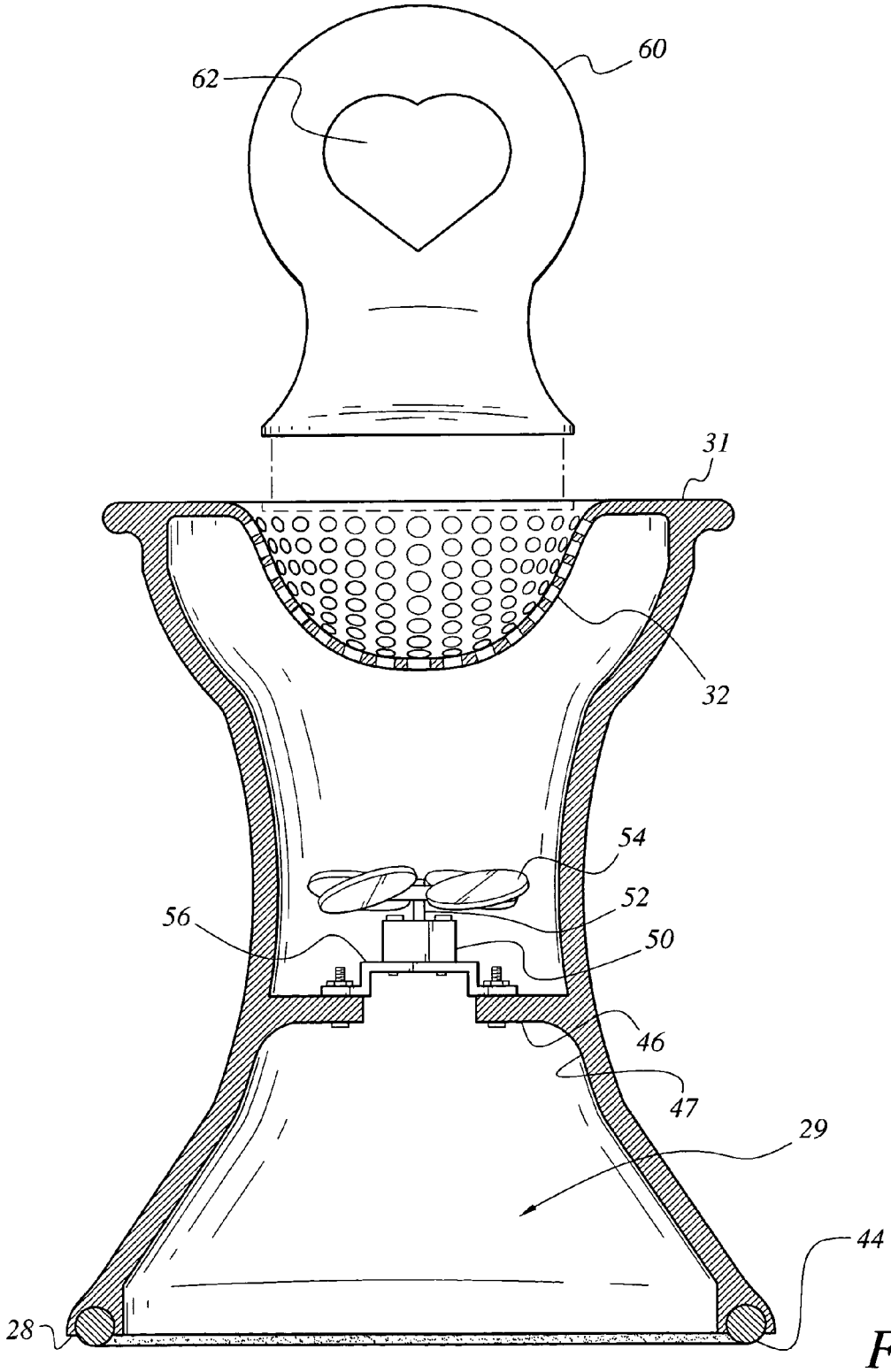
FIG. 6 is a front cut-away view of the body hair and feet drying chair of FIG. 1.

Turning now to FIGS. 5 and 6, open bottom of the base 20 can be seen, with the O-ring 44 disposed along the bottom edge 28 of the base 20. It can be seen that an electric motor 50 is disposed generally within the middle portion 24 of the base 20. Support arms 46 extend from an interior surface 47 of the base 20 to support a motor mounting bracket 56. The electric motor 50 is mounted on the bracket 56. A shaft 52 of the electric motor 50 turns a fan 54, the airflow directed upward so that air is drawn into the base through the air channels 40 and 42, and out from the base through the air outlets 34 and 36.

As an alternative to the open bottom 29, employing O-ring 44 to form an air seal against a floor surface, the bottom of the body hair and feet drying chair 10 may be closed, obviating the need for the O-ring 44. However, with an open bottom 29, the body hair and feet drying chair 10 may be placed over a floor heating vent to provide a source of heated air. In another embodiment, the motorized fan may be eliminated, the body hair and feet drying chair 10 relying entirely on air expelled from a floor vent, the air entering the hollow interior of the body hair and feet drying chair 10 through the open bottom 29 and exiting both the air outlets 34, 36 and the air channels 40 and 42.

It is to be understood that the present invention is not limited to the embodiment described above, but encompasses any and all embodiments within the scope of the following claims.

We claim:

1. A body hair and feet drying chair, comprising:

an upright base having a top portion, a middle portion, and a bottom portion, the upright base having a hollow interior, an open bottom, and a bottom edge surrounding the open bottom;

a rubber O ring disposed along said bottom edge of said open bottom, said rubber O ring configured to provide a seal between said bottom edge and a floor surface;

a seat disposed on the top portion of said base, the seat having a central concave portion and a rim portion, the rim portion surrounding the central concave portion, the central concave portion having a plurality of air outlets defined therein, the plurality of air outlets being in communication with the hollow interior of said base;

a footrest defined in the bottom portion of said base, said footrest formed as a depression in said base bottom portion, said footrest including a footrest floor with a plurality of air channels comprising apertures in said floor of said footrest, each of said air channels being in communication with the hollow interior of said base; and a motorized fan disposed within the middle portion of the hollow interior of said base, the motorized fan being configured to draw air into the hollow interior through said plurality of air channels in said footrest floor and to expel air from the hollow interior through said plurality of air outlets in said central concave portion of said seat.

2. The body hair and feet drying chair of claim 1, wherein said upright base is generally an hourglass shape having a widened bottom portion, a relatively narrow middle portion and a widened top portion.

3. The body hair and feet drying chair of claim 1, wherein said air outlets in said central concave portion of said seat include large air outlets centrally located within the central concave portion, medium air outlets surrounding the large air outlets, and small air outlets at the periphery of the central concave portion.

4. The body hair and feet drying chair of claim 1, further including a plurality of support arms extending inwardly from an interior surface of the base middle portion;

said plurality of support arms supporting a motor mounting bracket; and said motorized fan being mounted on said motor mounting bracket.

5. The body hair and feet drying chair of claim 1, further including an additional air outlet located in and disposed through the rear periphery of the rim portion of said seat.

6. The body hair and feet drying chair of claim 1, further including a sat back extending upwardly from said seat.

* * * * *